US007946673B2

(12) United States Patent
Reinten et al.

(10) Patent No.: US 7,946,673 B2
(45) Date of Patent: May 24, 2011

(54) METHOD OF PREPARING AN INK DUCT OF AN INKJET PRINTHEAD, AND AN INKJET PRINTER WHICH HAS BEEN MODIFIED FOR THIS METHOD TO BE APPLIED

(75) Inventors: Hans Reinten, Velden (NL); Henricus C. M. Krijnen, Asten (NL); Hubertus M. J. M. Boesten, Melick (NL)

(73) Assignee: Océ-Technologies B.V., Venlo (NL)

( * ) Notice: Subject to any disclaimer, the term of this patent is extended or adjusted under 35 U.S.C. 154(b) by 183 days.

(21) Appl. No.: 11/345,232

(22) Filed: Feb. 2, 2006

(65) Prior Publication Data

US 2006/0170725 A1 Aug. 3, 2006

(30) Foreign Application Priority Data

Feb. 3, 2005 (NL) ..... 1028176

(51) Int. Cl.
*B41J 29/393* (2006.01)
*B41J 29/38* (2006.01)

(52) U.S. Cl. ..... 347/19; 347/14

(58) Field of Classification Search ..... 347/14, 347/19

See application file for complete search history.

(56) References Cited

U.S. PATENT DOCUMENTS 4,498,088 A * 2/1985 Kanayama ..... 347/92
6,257,694 B1 7/2001 Tokumaru et al.
2004/0207683 A1* 10/2004 Sonobe ..... 347/23
2004/0227782 A1* 11/2004 Shinkawa et al. ..... 347/19
2004/0263547 A1* 12/2004 Sugahara ..... 347/9

FOREIGN PATENT DOCUMENTS

| | | | |
|---|---|---|---|
| EP | 1 013 453 | A2 | 6/2000 |
| JP | 03-244546 | A | 10/1991 |
| JP | 11-099646 | A | 4/1999 |
| JP | 2001-047639 | A | 2/2001 |
| JP | 2002-127445 | A | 5/2002 |
| JP | 2004-216818 | A | 8/2004 |

OTHER PUBLICATIONS

Patent Abstracts of Japan, deel 013, nr. 411 (M-869), Sep. 11, 1989 & JP-01-150549, Jun. 13, 1989.

Patent Abstracts of Japan, deel 010, nr. 083 (M-466), Apr. 2, 1986 & JP-60-224552, Nov. 8, 1985.

* cited by examiner

*Primary Examiner* — Matthew Luu
*Assistant Examiner* — Jannelle M Lebron
(74) *Attorney, Agent, or Firm* — Birch, Stewart, Kolasch & Birch LLP

(57) ABSTRACT

A method of preparing an inkjet printhead, prior to generating an image onto a receiving medium, the printhead containing a substantially closed ink duct comprising an inlet opening and a nozzle, said duct being operationally connected to an electro-mechanical transducer, the method including the steps of arranging that the duct is filled with ink; generating a pressure wave in the ink, the pressure wave causing a deformation of the transducer which generates an electrical signal as a result; analyzing the electrical signal, and deciding on the basis of the analysis whether the inkjet printhead is ready to proceed with the printing of the image. The inkjet printer is also modified to perform the present method.

10 Claims, 3 Drawing Sheets

METHOD OF PREPARING AN INK DUCT OF AN INKJET PRINTHEAD, AND AN INKJET PRINTER WHICH HAS BEEN MODIFIED FOR THIS METHOD TO BE APPLIED

The present application claims priority under 35 U.S.C. §119 to The Netherlands Patent Application No. 1028176, filed Feb. 3, 2005, the entire contents of which are hereby incorporated by reference.

BACKGROUND OF THE INVENTION

The present invention relates to a method of preparing an inkjet printhead, prior to generating an image onto a receiving medium by the application of the printhead. The printhead contains multiple, substantially closed ink ducts, each having an inlet opening and a nozzle, said ducts each being operationally connected to a corresponding electro-mechanical transducer.

In order to prepare a printhead of this kind, which is known from the prior art, the ducts are often flushed with new ink. The ink is introduced into the duct via the inlet opening of the ducts, and flushed out via the nozzles, thus removing any contaminations, air bubbles, old ink residues and any other undesirable obstructions present in the ducts. In order to be virtually certain that all undesirable obstructions have been removed so that the printhead is ready to proceed and print an image, a relatively large amount of ink is flushed through the print head.

A disadvantage of this known method is that a relatively large amount of ink is lost when flushing the ink ducts of the print head. Furthermore, there is no absolute certainty that all undesirable obstructions (i.e. any disadvantageous state which has an adverse effect on the printing process, e.g. a dirt particle, an air bubble, a contaminated nozzle, an uneven ink temperature, incorrect ink, etc.) that may possibly be present in the ducts are actually removed by flushing the ducts. The present invention is directed to a method that obviates the above problems.

To this end, a method has been developed, wherein for each of the multiple ducts, it is arranged that the duct is filled with ink, a pressure wave is generated in the ink, the pressure wave causing a deformation of the corresponding transducer which generates an electrical signal as a result, the electrical signal is analyzed, and then it is determined whether the inkjet printhead is ready to proceed and print an image using an analysis of the electrical signal.

In this initial preparation, it is first guaranteed that the duct is filled with ink. If the initial process takes place with a printhead in which no "old" ink is present in the ducts, each duct must then first be filled with ink. If there is ink already present in the ducts, the filling process may be skipped if the presence of ink establishes that the ducts are already filled with ink. It is also possible that the ducts are partially filled with ink. In this case, only a partial refilling with new ink is required. The present method now comprises, for each of the said ink ducts, generating a pressure wave in the ink present in the duct. According to one embodiment, this pressure wave is generated by the actuation of a piezo-electrical transducer that is operationally connected to the duct. This may, for example, be the same transducer as the one referred to above. The pressure wave, in turn, causes a deformation of the transducer, which then generates an electrical signal as a result. As the form of the pressure wave depends on the conditions in the duct (the presence of air bubbles or dirt particles, for example, leads to the occurrence of another pressure wave), the electrical signal also depends on the conditions in the duct. Thus, by analyzing this signal, information on the conditions in the duct may be obtained. Based on this, it is possible to decide whether the duct is ready for jet ink printing. This information can be used to decide whether the print head as a whole is ready to print an image on a receiving material.

In the present method, it is no longer required to flush a relatively large amount of ink through each duct at each initial preparation. At the start of the initial process, i.e. without any ink having been flushed through the filled ducts, it is determined by application of the present method whether the ducts are ready. If it is determined, for example, that there are no undesirable obstructions present in the ducts, then the ducts are considered ready to transfer ink drops image-wise onto a receiving medium. In this case, it is therefore not required to flush new ink through the ducts. Furthermore, by application of the current method, there is a greater certainty regarding the actual readiness of the printer, as the state in the ducts is measured, whereas up to now it was customary to assume that the state was good after a large amount of new ink had been flushed through the duct. According to one embodiment, a repair action is applied if the printhead is not ready, after which the generation of the pressure wave, the resulting deformation of the transducer and the analysis of the signal generated by the transducer are repeated. According to this embodiment, for example, a small amount of ink is flushed through the obstructed duct in order to remove any undesirable obstruction which might be present. Another possible repair action, which is, for example, suitable for eliminating small air bubbles, is to temporarily leave the duct untreated to allow the air bubble to dissolve in the ink. Other repair actions, preferably geared to specific undesirable obstructions, are also possible. Once the repair action has been carried out, the state in the duct is again measured in the manner indicated above. If the undesirable obstruction has been removed by the repair action, it may be decided that the duct, and as a result possibly also the printhead, is ready to print. In this manner, a long initial preparation process may be avoided. As soon as the duct is free from undesirable obstructions, it may be decided that the printhead is ready to print. If the repair action that is chosen consists of flushing the duct with a small amount of ink, then the advantage of the current method would be that only a small amount of ink, that is an amount sufficiently adequate to remove the undesirable obstruction, is required to prepare the duct.

Moreover, it is known from European patent application EP 1 013 453 that an electro-mechanical transducer of an inkjet printer, apart from generating a pressure wave in the duct, may also be used as a sensor to obtain information on the state of the duct. However, from said application, it is only known to apply this in order to trace undesirable obstructions that occur during the printing process. It is not known from the European application to apply its method in order to check the duct for the presence of undesirable obstructions during the initial process, nor to decide, based on the European application thereof, whether the printhead is ready to proceed and print an image.

According to one embodiment, a pressure wave is generated such that an ink drop is ejected from a nozzle if the printhead operates normally. According to this embodiment, the generation of the pressure wave coincides with the ejection of an ink drop. The advantage of this embodiment is that the state of the ducts is measured under conditions that may be equivalent to that which exists during the actual use of the ducts during the printing process of an image. Furthermore, the additional advantage occurs that by jetting an ink drop, a small amount of ink is, in fact, flushed through the duct. In this manner, it is, for example, possible that no additional repair action is required to remove undesirable obstructions.

According to another embodiment, where the inkjet printhead comprises a collection of individually actuatable ink ducts and associated electro-mechanical transducers, the method comprises: preparing the printhead; deforming the associated transducer for each of the ducts of the collection; and analyzing the signals generated as a result. According to this embodiment, the method according to the present invention is applied to each duct of the printhead. Therefore, the preparation process takes place while each of the ducts are measured so that it may be determined for each of these ducts whether one or more undesirable obstructions are present. This information may be applied when deciding whether the printhead is ready to print an image.

In another embodiment, it is decided that the inkjet printhead is not ready if an undesirable obstruction is present in a duct. According to this embodiment, it is opted to only complete the preparation process of the printhead once each of the ducts is fully deployable to proceed to print an image. The advantage of this method is that it allows for optimal use to be made of the printhead and that it is not necessary to take ducts into account for printing which have a deviant property or absolutely lack the ability to jet ink drops for creating an image.

According to an alternative embodiment, it is decided that the inkjet printhead is ready despite an undesirable obstruction being present in an ink duct. According to this embodiment, it is opted to complete the preparation process of the printhead despite an undesirable obstruction being present in one or more ink ducts. The advantage of this embodiment is, for example, that the initial process is not required to be continued for a long time, unnecessarily, if there is an undesirable obstruction present in a duct that will not be required for printing the next image. In this case, the initial process may simply be completed, after which, the printing process of the image may be started. It may also be a fact that there is an undesirable obstruction present in a duct, the undesirable obstruction being of such a nature that it will disappear very quickly during the printing process and thus seldom produce any visible print artefacts. In this case, the present method allows the initial process to be completed despite the presence of an undesirable obstruction in one of the ducts.

According to another embodiment, the decision to print is made if there is at least a predetermined number of ink ducts without an undesirable obstruction. According to this embodiment, it is assumed that there is a minimum number of ink ducts required in the printhead for the printhead to be able to print an image. As soon as it appears from the initial process that this minimum number of ink ducts has been achieved, it may be decided that the printhead is ready to print an image.

According to another embodiment, the decision is made if it is determined that the undesirable obstruction is persistent. A persistent undesirable obstruction is one which cannot be removed, at least within a reasonable time, during the initial process. It may then still be decided that the printhead is ready nonetheless, where the duct in which the persistent undesirable obstruction is located will, for example, not be used during the printing process of the image. It may then be decided again at a later stage, for example, after expiration of or during the printing process of the image, whether the undesirable obstruction is still present or not.

According to one embodiment, the image is printed by application of those ducts which are free from any undesirable obstruction. This has the advantage that no print artefact need to occur in the image.

The present invention thus relates to an inkjet printer containing a printhead with a substantially closed ink duct containing an inlet opening and a nozzle, said duct being operationally connected to an electro-mechanical transducer, the printer including a control which has been modified such that it may control the printer to automatically carry out the present method.

BRIEF DESCRIPTION OF THE DRAWINGS

The present invention will now be further explained with reference to the following examples, wherein.

DETAILED DESCRIPTION OF THE INVENTION

Figure 1:
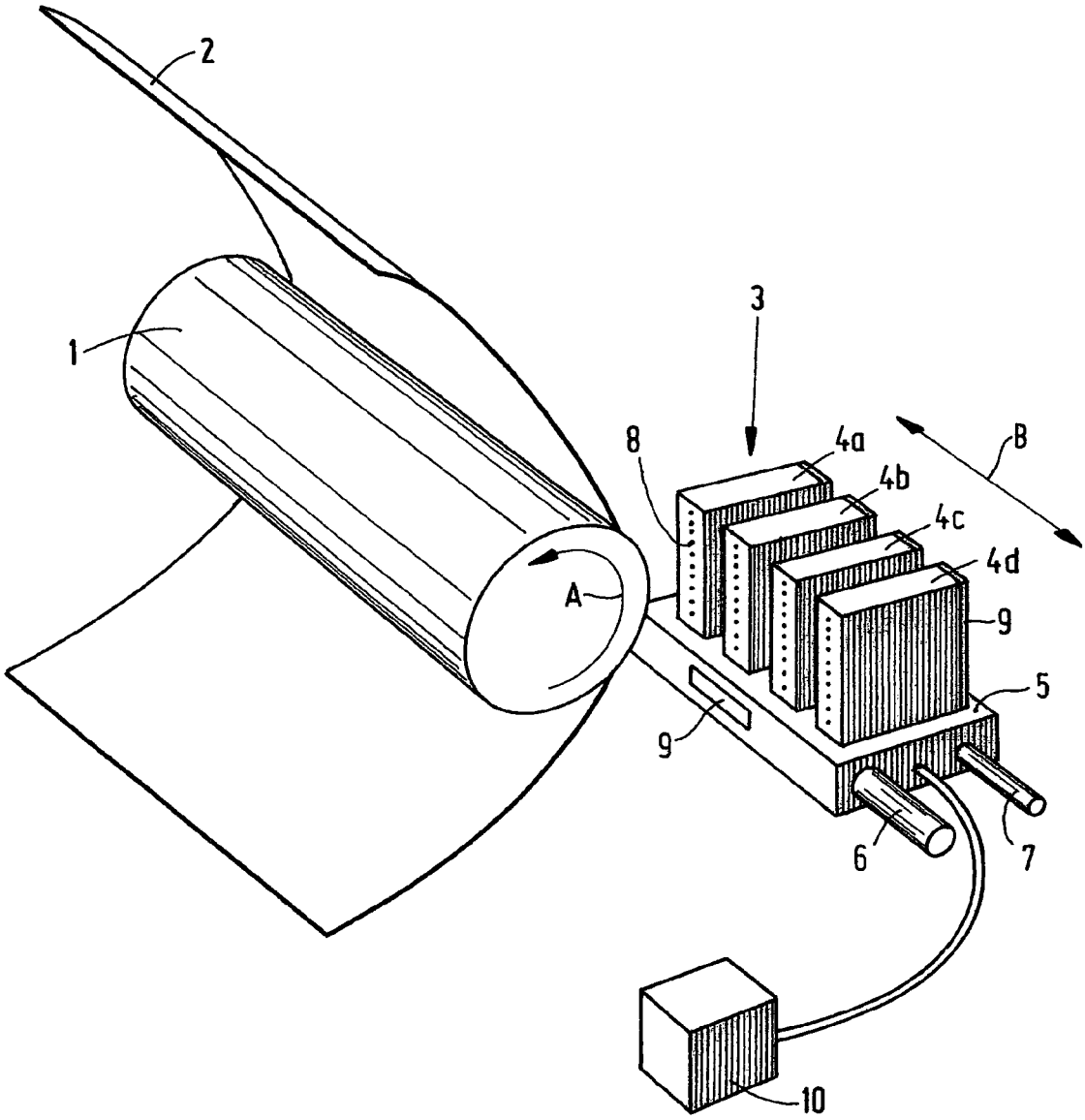
FIG. 1 is a diagram showing an inkjet printer.

FIG. 1 is a diagram showing an inkjet printer. According to this embodiment, the printer comprises a roller 1 used to support a receiving medium 2, such as a sheet of paper or a transparency, and move it along the carriage 3. The carriage includes a carrier 5 to which four printheads 4*a*, 4*b*, 4*c* and 4*d* have been fitted. Each printhead contains its own color, in this case cyan (C), magenta (M), yellow (Y) and black (K) respectively. The printheads are heated using heating elements 9, which have been fitted to the rear of each printhead 4 and to the carrier 5. The temperature of the printheads is maintained at the correct level by application of a central control unit 10 (controller).

The roller 1 may rotate around its own axis as indicated by arrow A. In this manner, the receiving medium may be moved in the sub-scanning direction (often referred to as the X direction) relative to the carrier 5, and therefore also relative to the printheads 4. The carriage 3 may be moved in reciprocation using suitable drive mechanisms (not shown) in a direction indicated by double arrow B, parallel to roller 1. To this end, the carrier 5 is moved across the guide rods 6 and 7. This direction is generally referred to as the main scanning direction or Y direction. In this manner, the receiving medium may be fully scanned by the printheads 4.

According to the embodiment as shown in this figure, each printhead 4 comprises a number of internal ink ducts (not shown), each with its own exit opening (nozzle) 8. The nozzles in this embodiment form one row per printhead, perpendicular to the axis of roller 1 (i.e. the row extends in the sub-scanning direction). According to a practical embodiment of an inkjet printer, the number of ink ducts per printhead will be many times greater and the nozzles will be arranged over two or more rows. Each ink duct comprise a piezo-electric transducer (not shown) that may generate a pressure wave in the ink duct so that an ink drop is ejected from the nozzle of the associated duct in the direction of the receiving medium. The transducers may be actuated image-wise via an associated electrical drive circuit (not shown) by application of the central control unit 10. In this manner, an image built up of ink drops may be formed on receiving medium 2.

If a receiving medium is printed using such a printer where ink drops are ejected from ink ducts, the receiving medium, or a part thereof, is imaginarily split into fixed locations that form a regular field of pixel rows and pixel columns. According to one embodiment, the pixel rows are perpendicular to the pixel columns. The individual locations thus produced may each be provided with one or more ink drops. The number of locations per unit of length in the directions parallel to the pixel rows and pixel columns is called the resolution of the printed image, for example indicated as 400×600 d.p.i. ("dots per inch"). By actuating a row of printhead nozzles of the inkjet printer, image-wise when it is moved relative to the receiving medium as the carrier 5 moves, an image, or part thereof, built up of ink drops is formed on the receiving medium, or at least in a strip as wide as the length of the nozzle row.

Figure 2:
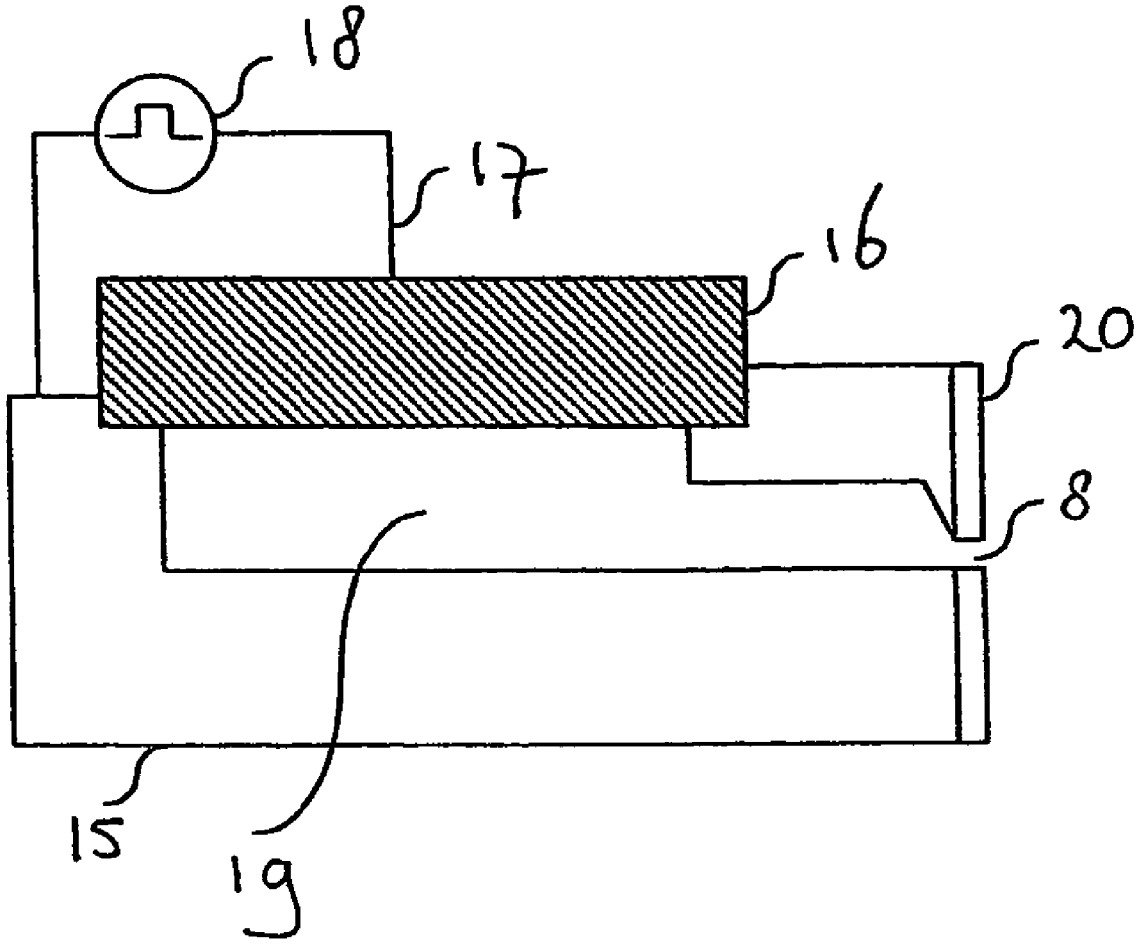
FIG. 2 is a diagram showing an ink duct assembly and its associated transducer.

FIG. 2 shows an ink duct 19 comprising a piezo-electric transducer 16. Ink duct 19 is formed by a groove in base plate 15 and is limited at the top mainly by piezo-electric transducer 16. Ink duct 19 terminates into an exit opening 8 at the end, this opening being partially formed by a nozzle plate 20 in which a recess has been made at the level of the duct. When a pulse is applied across transducer 16 by a pulse generator 18 via actuation circuit 17, the transducer bends in the direction of the duct. This produces a sudden pressure rise in the duct, which in turn generates a pressure wave in the duct. If the pressure wave is strong enough, an ink drop is ejected from exit opening 8. After the expiration of the ink drop ejection process, the pressure wave, or a part thereof, is still present in the duct, after which the pressure wave will fully damp over time. This pressure wave in turn results in a deformation of transducer 16, which then generates an electrical signal. This signal depends on all the parameters that influence the generation and the damping of the pressure wave. In this manner, as known from European patent application EP 1 013 453, it is possible by measuring this signal, to obtain information on these parameters, such as the presence of air bubbles or other undesirable obstructions in the duct. This information may then, in turn, be used to check and control the printing process.

Figure 3:
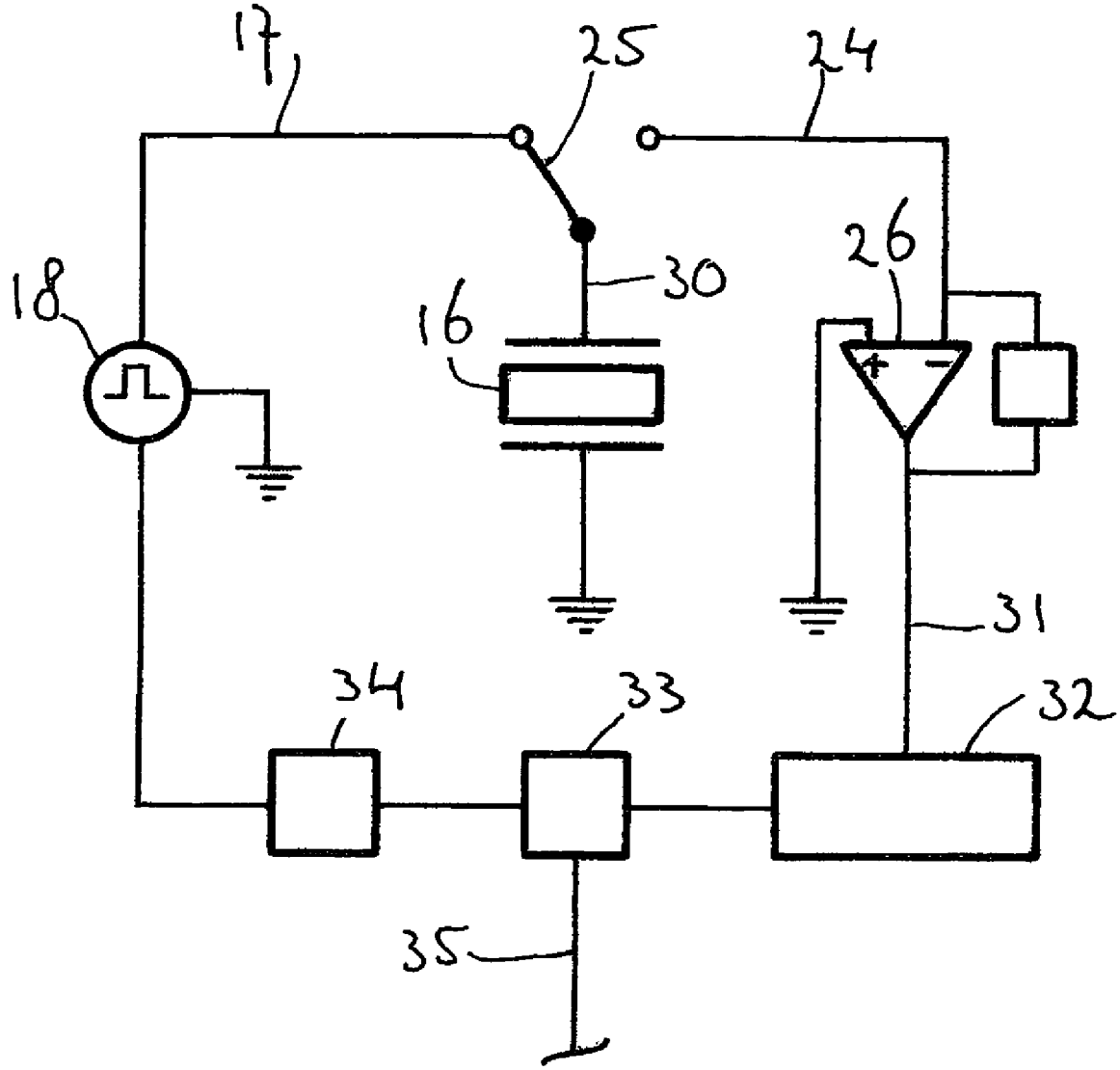
FIG. 3 is a block diagram showing a circuit that is suitable for measuring the state in the ink duct by the application of the transducer used as a sensor.

FIG. 3 is a block diagram showing the piezo-electric transducer 16, the actuation circuit (items 17, 25, 30, 16 and 18), the measuring circuit (items 16, 30, 25, 24, and 26) and control unit 33, according to one embodiment. The actuation circuit, comprising a pulse generator 18, and the measuring circuit, comprising an amplifier 26, are connected to transducer 16 via a common line 30. The circuits are opened and closed by two-way switch 25. Once a pulse has been applied across transducer 16 by pulse generator 18, transducer 16 is in turn deformed by the resulting pressure wave in the ink duct. This deformation is converted into an electrical signal by transducer 16. After expiration of the actual actuation, two-way switch 25 is converted so that the actuation circuit is opened and the measuring circuit is closed. The electrical signal generated by the transducer is received by amplifier 26 via line 24. According to this embodiment, the resulting voltage is fed via line 31 to A/D converter 32, which conveys the signal to control unit 33. This is where analysis of the measured signal takes place. If necessary, a signal is sent to pulse generator 18 via D/A converter 34 so that a subsequent actuation pulse is modified to the current state of the duct. Control unit 33 is connected to the central control unit of the printer (not shown in this figure) via line 35, allowing information to be exchanged with the rest of the printer and/or the outside world.

Example 1 describes a method and printer according to the present invention. In the example to be outlined below, the central control unit 10, this unit being a part of the inkjet printer control, comprises processors which have been programmed to measure the state in each of the ink ducts, during the initial process, also referred to as "start-up", of the printer, by using the analysis means as described in connection with FIG. 3.

The initial process of the printer comprises warming-up the printheads to the operational temperature, which is typically 130° C. for an inkjet printer which utilizes so-called hot melt ink. Next, the printheads are filled with liquid ink, if necessary, via a dosage system (not shown in FIG. 1). If it concerns a restart of the printheads, they will usually still be filled with ink (where a duct that contains a number of air bubbles apart from the ink present may be deemed to be filled). Per head, the analysis of the state of the individual ink ducts takes place next, as embodied by the present invention. To this end, all ink ducts of a printhead, i.e. each of the associated piezo-electric transducers, will be actuated such that in principle, 5 ink drops would be ejected per duct (in the case of a properly functioning duct). These ink drops are, for example, collected in a service station of the inkjet printer and discharged as waste. Next, by application of the means as described in connection with FIGS. 2 and 3, it is assessed which of the ducts is free from any undesirable obstruction and therefore ready to be applied when printing an image. If there are still ducts which experience an undesirable obstruction, for example an air bubble in the duct, a large solid particle in the duct, contamination around the nozzle, a mechanical error in the duct itself, absence of ink in the duct, absence of good quality ink in the duct, a temperature below par in the duct (ink too viscous), etc. then it may be decided to actuate the transducers again in such a manner that, in principle, 5 ink drops are ejected from each duct. After this, analysis of the state of the ducts in the printhead may again take place.

Table 1 below shows how many ducts of a printhead consisting of 240 ducts are free from any undesirable obstruction after each series of actuations (aimed at ejecting 5 ink drops per duct as indicated above). It should be noted here, that the first series of actuations (n=1 in table 1) is aimed at ejecting 15 drops of ink.

TABLE 1

Table 1. Number of ducts that are free from any undesirable obstruction after the $n^{th}$ series of actuations of the transducers associated with these ducts.

| Actuation series n | Ducts free from undesirable obstructions [#] | Ducts free from undesirable obstructions [%] |
|---|---|---|
| 0 | 132 | 55 |
| 1 | 168 | 70 |
| 2 | 192 | 80 |
| 3 | 216 | 90 |
| 4 | 228 | 95 |
| 5 | 235 | 98 |
| 6 | 238 | 99 |
| 7 | 238 | 99 |
| 8 | 238 | 99 |

It may be seen that after the printheads have been filled, only as few as 132 of the 240 ducts are free from any undesirable obstruction. As this is barely more than half the number of ducts, it is decided that this printhead is not ready and that the initial procedure is resumed. After the first series of actuations, it appears that already 70% of the ducts is free from undesirable obstruction. Apparently, actuation of the transducer in a duct with an undesirable obstruction often leads to repair of the duct. The percentage of ducts without any undesirable obstruction reaches 99% after the sixth series due to these repair actions. In this example, a seventh and eight series of actuations do not remove the undesirable obstruction(s) from the last two ducts. The undesirable obstructions in this duct may be deemed to be persistent as they still do not disappear after three series of actuations.

According to this embodiment, it is decided after the eighth series of actuations that the printhead in question is ready to proceed and print. There are, however, two ducts that are not free from undesirable obstruction, but this may be taken into account when printing, as is known from the prior art. Thus, the data to be printed may be easily divided over the ducts that are free from undesirable obstruction. After having printed using this printhead for, for example, 15 minutes, it may be checked again whether either duct experiences an undesirable obstruction. If not, then they may still be used in the printing process. If there is any undesirable obstruction, then it may be checked again after another interval whether the undesirable obstruction is still present in the duct. According to one embodiment, if it appears that the undesirable obstructions still do not disappear after a number of intervals, it may be decided to proceed to a repair action for these ducts, for example, by pressure flushing these ducts, as is known from the prior art. It would also be possible for the associated transducers to be actuated using dedicated repair pulses specifically aimed at removing the undesirable obstruction which is present. If the undesirable obstructions do not disappear, this may also lead to the initiation of servicing.

According to an alternative embodiment, only the transducers of those ducts which appear to experience an undesirable obstruction are actuated during the initial process. In the example given above, there is an undesirable obstruction in 108 ducts immediately after filling (series 0). By actuating the transducers of these ducts only, ink may be saved, as jetting ink drops from ducts that are already free from undesirable obstructions during the initial process wastes good quality ink and does not produce any improvement. After each series of actuations, a smaller group of ducts is thus selected, these ducts still being required to undergo the initial process according to the invention. This may lead to a relatively large saving of ink.

According to one embodiment, analysis of the state of the ducts starts as early as during the warm-up of the printhead, as each of the printheads is often already filled with ink as they have already been previously used, for example the previous day, for printing one or more images. It may often be seen, before the operational temperature of the printhead is reached, whether a duct is free from undesirable obstructions.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A method of preparing an inkjet printhead, prior to generating an image onto a receiving medium, the printhead containing a plurality of substantially closed ink ducts, each having an inlet opening and a nozzle, each of said ducts being operationally connected to a corresponding electro-mechanical transducer, the method comprising, for each of the plurality of ducts:

arranging that the duct is filled with ink, prior to printing, generating a pressure wave in the ink, the pressure wave causing a deformation of the corresponding transducer which generates an electrical signal, analyzing the electrical signal in order to determine whether an undesirable obstruction is present, and to determine the nature of the undesirable obstruction, deciding on the basis of the analysis whether the inkjet printhead is ready to proceed and print the image using the analysis of the electrical signal, wherein, when it is determined that an undesirable obstruction is present, it is decided that the inkjet printhead is ready to proceed where the obstruction does not lead to any visible artifacts and otherwise where the print head is not ready to proceed.

2. The method according to claim 1, wherein, when the printhead is not ready, a repair action is carried out, after which the actuation of the transducer, the analysis of the signal generated as a result thereof, and the decision are repeated.

3. The method according to claim 1, wherein a pressure wave is generated such that, in a normally functioning printhead, an ink drop is ejected from the nozzle.

4. The method according to claim 1, wherein it is decided that the inkjet printhead is not ready when an undesirable obstruction is present in one single duct of said multiplicity of ducts.

5. The method according to claim 1, wherein the decision is made when there is at least a predetermined number of ink ducts without an undesirable obstruction.

6. The method according to claim 1, wherein the decision is made when it is determined that the undesirable obstruction is persistent.

7. The method according to claim 1, wherein the image is printed by application of those ducts which are free from any undesirable obstruction.

8. An inkjet printer comprising a printhead containing multiple closed ink ducts each containing an inlet opening and a nozzle, each of the said ducts being operationally connected to a corresponding electro-mechanical transducer, the printer further including a control which has been modified to automatically carry out the method according to claim 1.

9. The method of claim 1, wherein for each of said ink ducts a pressure wave is generated by the actuation of the electro-mechanical transducer, the pressure wave causing a deformation of the transducer which, in turn, generates the electrical signal, said electrical signal and a form of the pressure wave defining a cause or type of undesirable obstruction in the duct.

10. The method according to claim 1, wherein, when it is decided that the printhead is not ready to proceed, a repair action geared to the nature of the undesirable obstruction is selected and the selected repair action is performed.

* * * * *